United States Patent [19]

Ing-Hsiang

[11] Patent Number: 4,972,784

[45] Date of Patent: Nov. 27, 1990

[54] INTELLECTRONIC SAFE DEPOSIT BOX

[76] Inventor: Lee Ing-Hsiang, No. 29, Nanking E.Rd.Sec, 3, Taipei, Taiwan

[21] Appl. No.: 405,773

[22] Filed: Sep. 11, 1989

[51] Int. Cl.[5] ..... E05G 3/00

[52] U.S. Cl. ..... 109/3; 109/24.1; 109/58.5; 109/59 R; 109/66; 70/16

[58] Field of Search ..... 109/3, 24.1, 31, 38, 109/59 R, 59 T, 66, 55, 49.5, 58.5; 70/15, 16

[56] References Cited

U.S. PATENT DOCUMENTS

| | | | |
|---|---|---|---|
| 697,462 | 4/1902 | Elmer | 109/3 |
| 2,106,849 | 2/1938 | Long | 70/16 X |
| 3,545,237 | 12/1970 | Thompson et al. | 70/16 |
| 3,726,238 | 4/1973 | Gordon | 109/3 |
| 3,965,827 | 6/1976 | Reeves | 109/3 |
| 4,278,033 | 7/1981 | Sobel | 109/59 R |
| 4,312,277 | 1/1982 | Graef et al. | 109/66 X |
| 4,481,887 | 11/1984 | Urbano | 109/3 |
| 4,555,991 | 12/1985 | Bellezza | 109/58.5 X |
| 4,615,280 | 10/1986 | Shoop et al. | 109/24.1 |
| 4,706,577 | 11/1987 | Jones | 109/59 T |

FOREIGN PATENT DOCUMENTS

| | | | |
|---|---|---|---|
| 2448024 | 10/1980 | France | 109/3 |

*Primary Examiner*—Robert L. Wolfe
*Assistant Examiner*—Suzanne L. Dino
*Attorney, Agent, or Firm*—Asian Pacific Int'l Patent & Trademark Office

[57] ABSTRACT

An intellectronic safe deposit box which is generally comprised of a housing and an electronic security control portion and characterized in that any wrong numerical code input made by burglar will be immediately detected by means of electronic control and the processing of a central processor to drive a handcuff mechanism, which is set in the electronic security control portion, to manacle burglar's hand.

5 Claims, 7 Drawing Sheets

INTELLECTRONIC SAFE DEPOSIT BOX

Regular safe deposit boxes are specifically designed for receiving precious articles or documents, although they may vary in design or outer configuration. However, in actual practice, conventional safe deposit boxes have been proved effective against ordinary people but not evil-doers. Although electronic type numerical or secret code control safe deposit boxes have been commonly used, they still can not completely beat the force of evil. The evil-doers may directly take a safe deposit box away when they find they cannot unlock the a safe deposit box. Further, following the continuous development of advanced tools, the strong casings of conventional safe deposit boxes may be easily destroyed although such casings may be temporarily effective against fire or shock. Even the most advanced electronic locking device of a safe deposit box may be unlocked by evil-doers although a longer time consumption may be required.

In recent years, security problems have been getting more serious. It is frequently heard that a newly developed safe deposit box has been stolen by burglars. It is very embarrassing that a safe deposit box is longer effective to protect against burglars. Further, inconveniences may arise operation because a user tends to forget the correct secret code number or gives a wrong input in attempting to unlock an electronically controlled safe deposit box.

It is therefore, the main object of the present invention to provide an intellectronic safe deposit box to effectively protect against burglary which is microprocessor-controlled through numerical input, having set therein a handcuff to efficiently manacle the hand of any person who gives a wrong numerical input, of which the numerical control code may be flexibly set according to requirements.

The present invention relates to an intellectronic safe deposit box and more particularly to one which comprises therein a handcuff mechanism and is characterized in that the security system will be triggered to alarm and the handcuff mechanism will be simultaneously driven to manacle the hand which touches the control panel and gives a wrong numerical input; the alarm system will also be triggered to alarm when the internal locking device or the housing of the safe deposit box is damaged by outside force.

Figure 1:
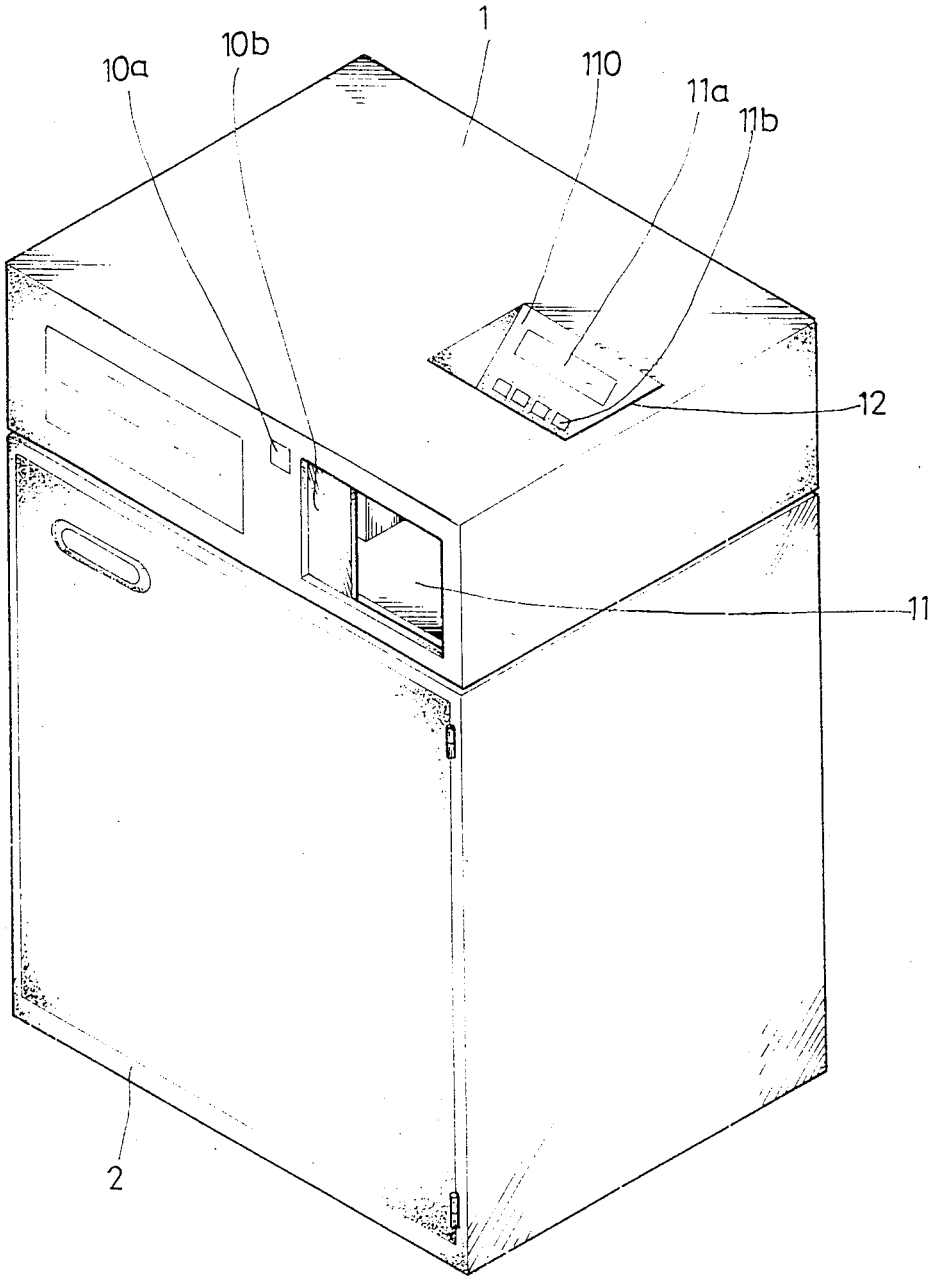
FIG. 1 illustrates an intellectronic safe deposit box embodying the present invention.

Referring to FIG. 1, therein illustrated is an intellectronic safe deposit box embodying the present invention and generally comprised of an electronic security control portion (1) having set therein a handcuff mechanism, and a housing (2). The housing is unitarily made of special alloy through shape-forming process, which is strong and resistant against heat upto 1800° C.–2500° C. The electronic security control portion is operated by means of a microprocessor through 6-digit numerical code input. According to the present invention, the numerical code can be flexibly determined according to requirements which may include as much as one million numerical code combinations. Through a central processing unit for access control, no key is required. In case a wrong numerical code input is made, the concealed handcuff mechanism will be immediately triggered to tightly manacle the wrist of the person who touches the keyboard for code input. As illustrated, the electronic security control portion is a rectangular structure comprising a control panel (110) having a 6-digit display (11*a*) (for example, LCD or 7-segment digital display) for display of the numerical code input therein through the keys (11*b*), which control panel (110) is located at the inner end of a slot (11) of the electronic security control portion (1). The slot (11) of the electronic security control portion (1) defines an elongated rectangular space through which one may stretch out one's hand to operate the control panel (110). The control panel (110) is obliquely set inside the slot (11) at a position below a transparent bullet-proof and impact resistant glass (12) which is located on the top of the electronic security control portion (1) and through which one can see clearly his or her finger operation on the control panel (110). A door (10*b*) is mounted on the outer end of the slot (11), and a switch (10*a*) is mounted on the front surface of the electronic security control portion (1) to control the door (10*b*). For numerical code input, one shall have to press on the switch (10*a*) to open the door (10*b*) so as to stretch one's hand into the slot (11) to operate the control panel (110).

Figure 2:
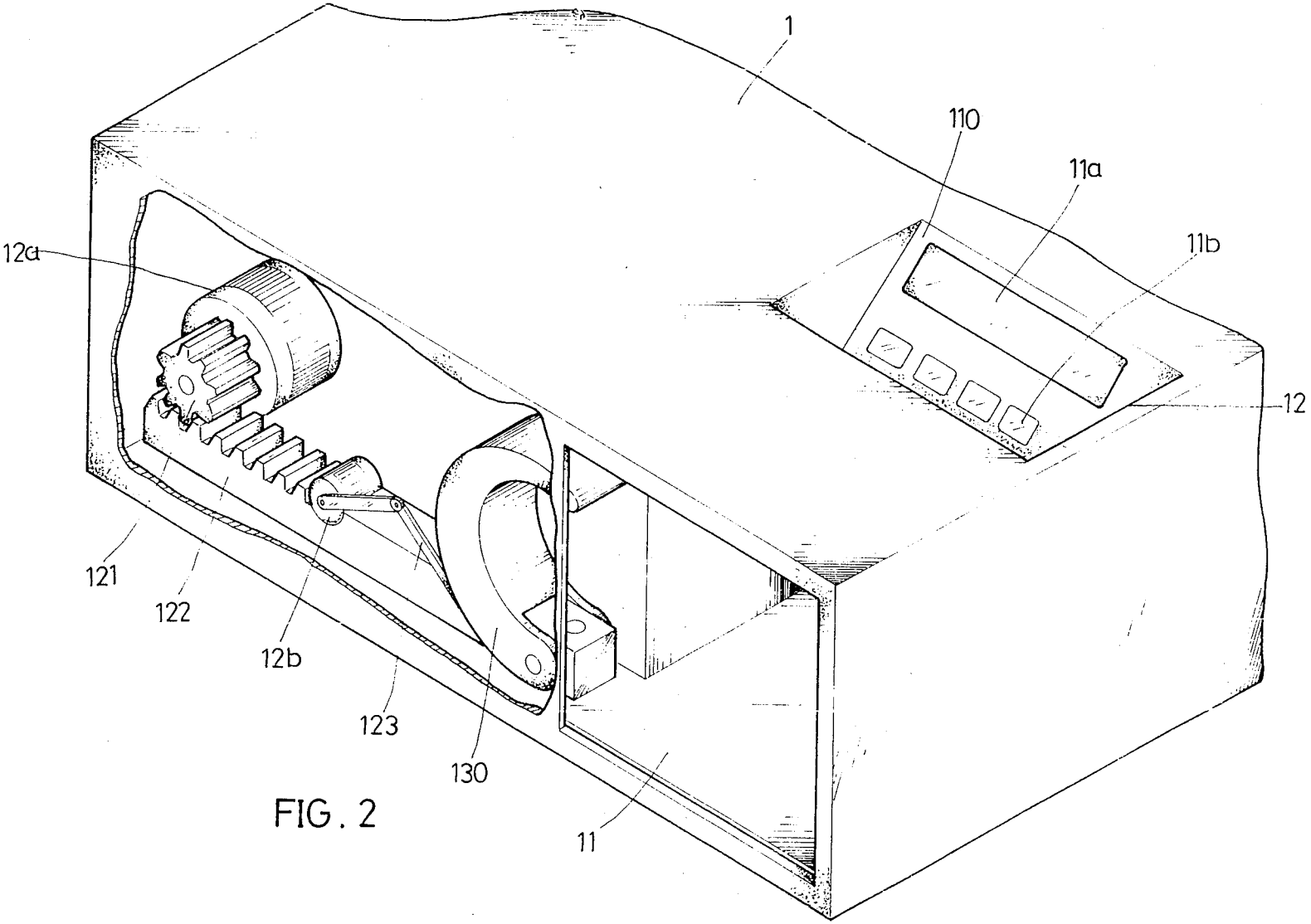
FIG. 2 is a partly perspective view of the handcuff mechanism of the electronic security control portion of the present invention.
Figure 3:
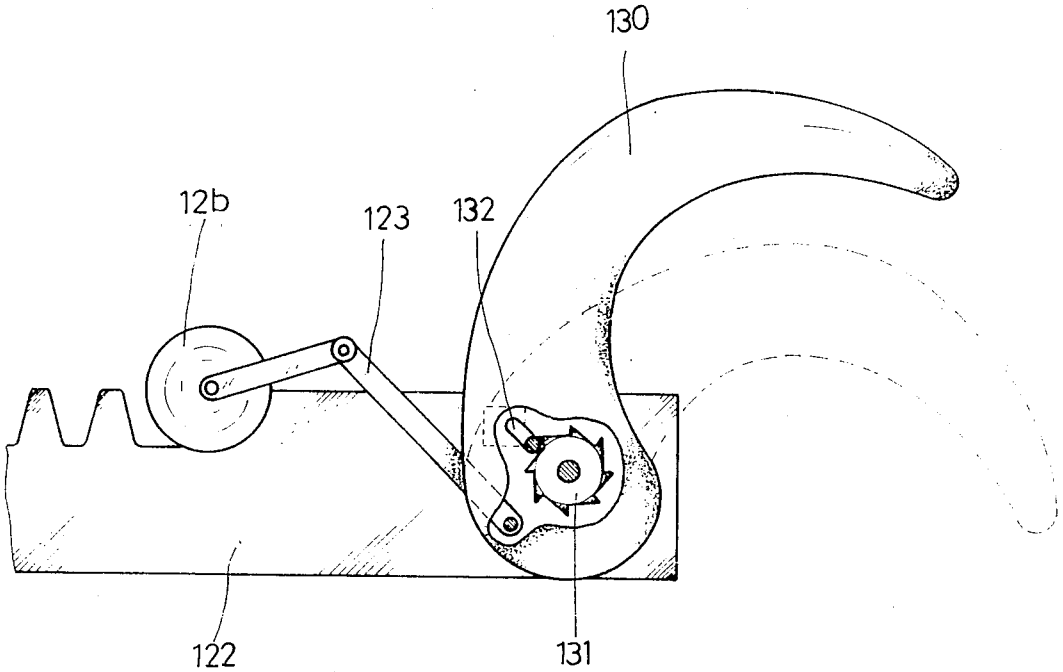
FIG. 3 is a plan view of the handcuff mechanism of the present invention.

Referring to FIG. 2, the handcuff mechanism of the electronic security control portion (1) is generally comprised of a handcuff (130) driven by a motor (12*a*) through a movable rack (122). A second motor 12*b* is mounted on the rack. The two motors are energized sequentially to operate the handcuff mechanism. As shown in FIG. 3, when the pivoted arm (123) is pushed by the motor (12*b*) to drive the handcuff (130) to snap down, the ratchet (131) is immediately locked up by the cross pin (132) to let the handcuff (130) be firmly retained in a locked position.

Figure 4:
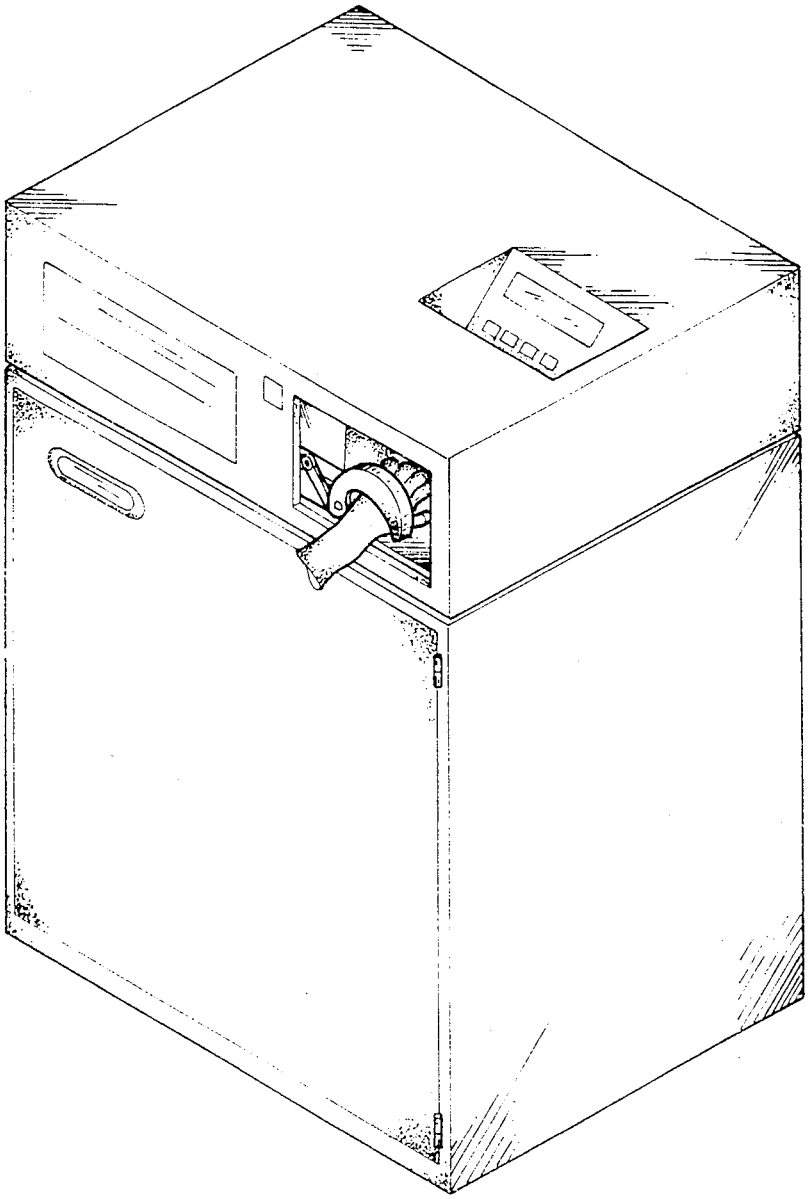
FIG. 4 is a schematic view of the present invention, illustrating that a hand is manacled by the handcuff mechanism.

As shown in FIG. 4 which illustrates a hand snapped by the handcuff (130), when a wrong numerical code is given to the control panel (110), the handcuff (130) is immediately driven to manacle the hand stretched in the slot (11), and the on-line security system will be simultaneously triggered to inform a guard or public-security organization to catch the burglar.

Figure 5:
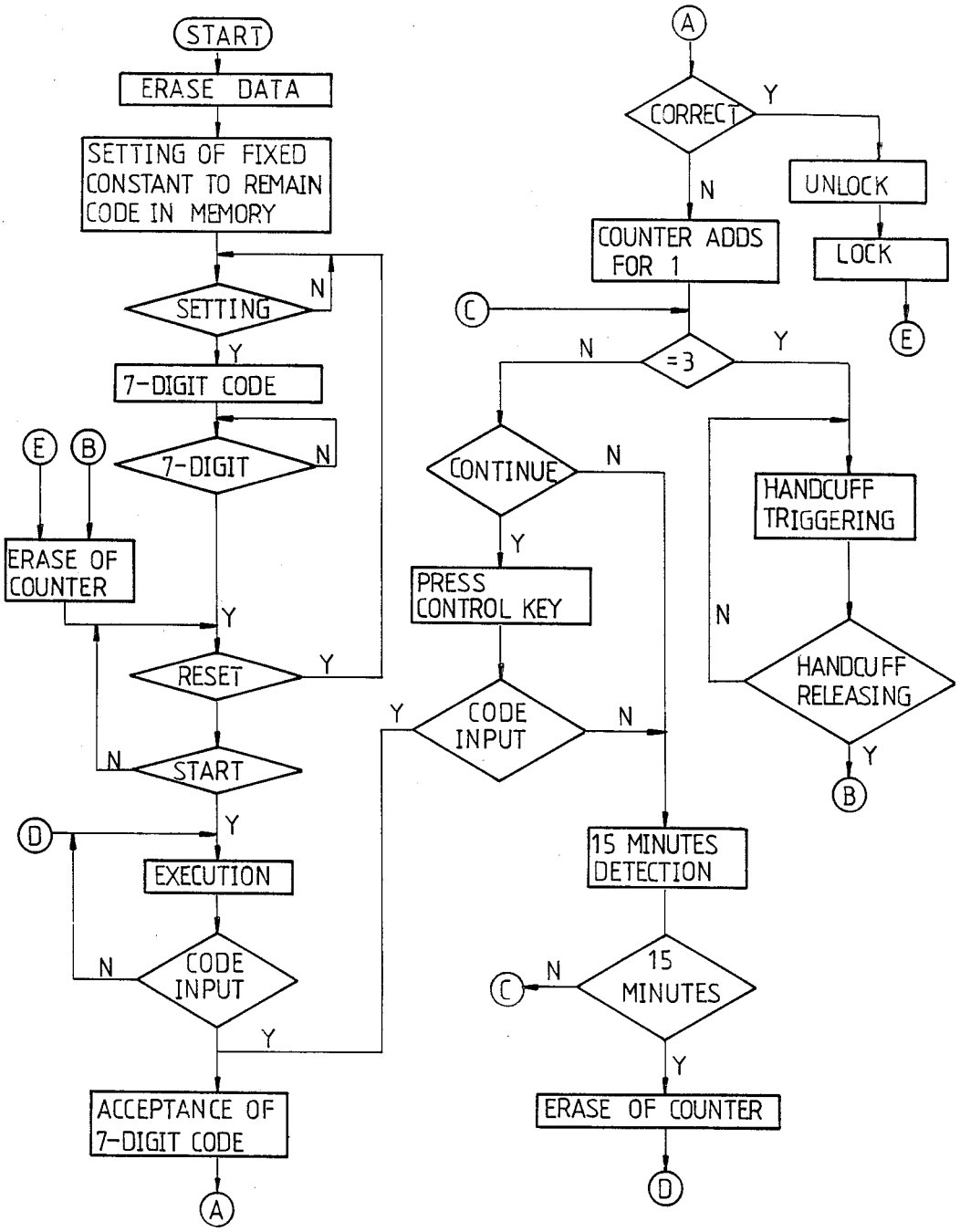
FIG. 5 is a flow chart illustrating the operational procedure of the present invention.
Figure 6:
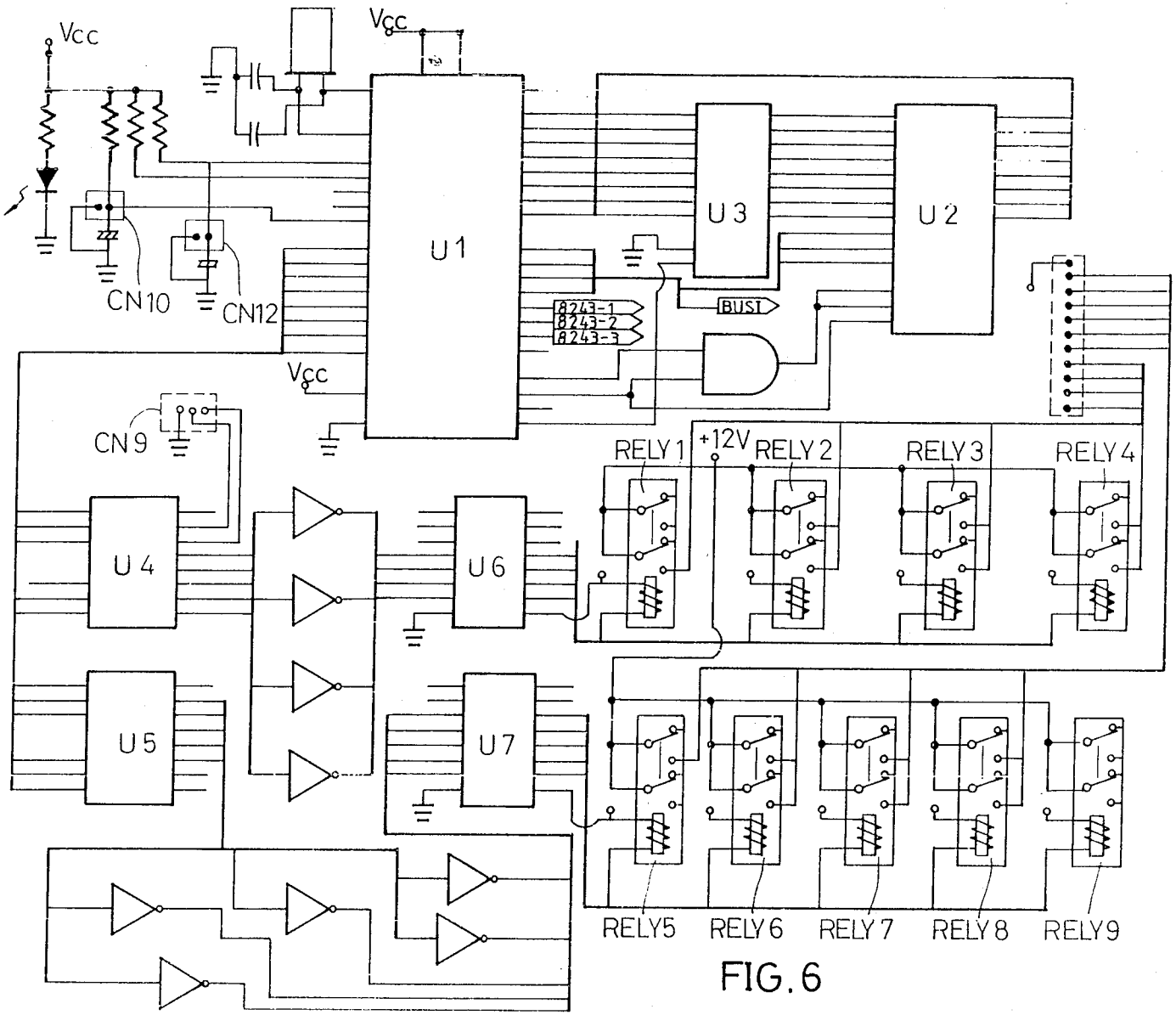
FIG. 6 is a control circuit diagram of the present invention.
Figure 7:
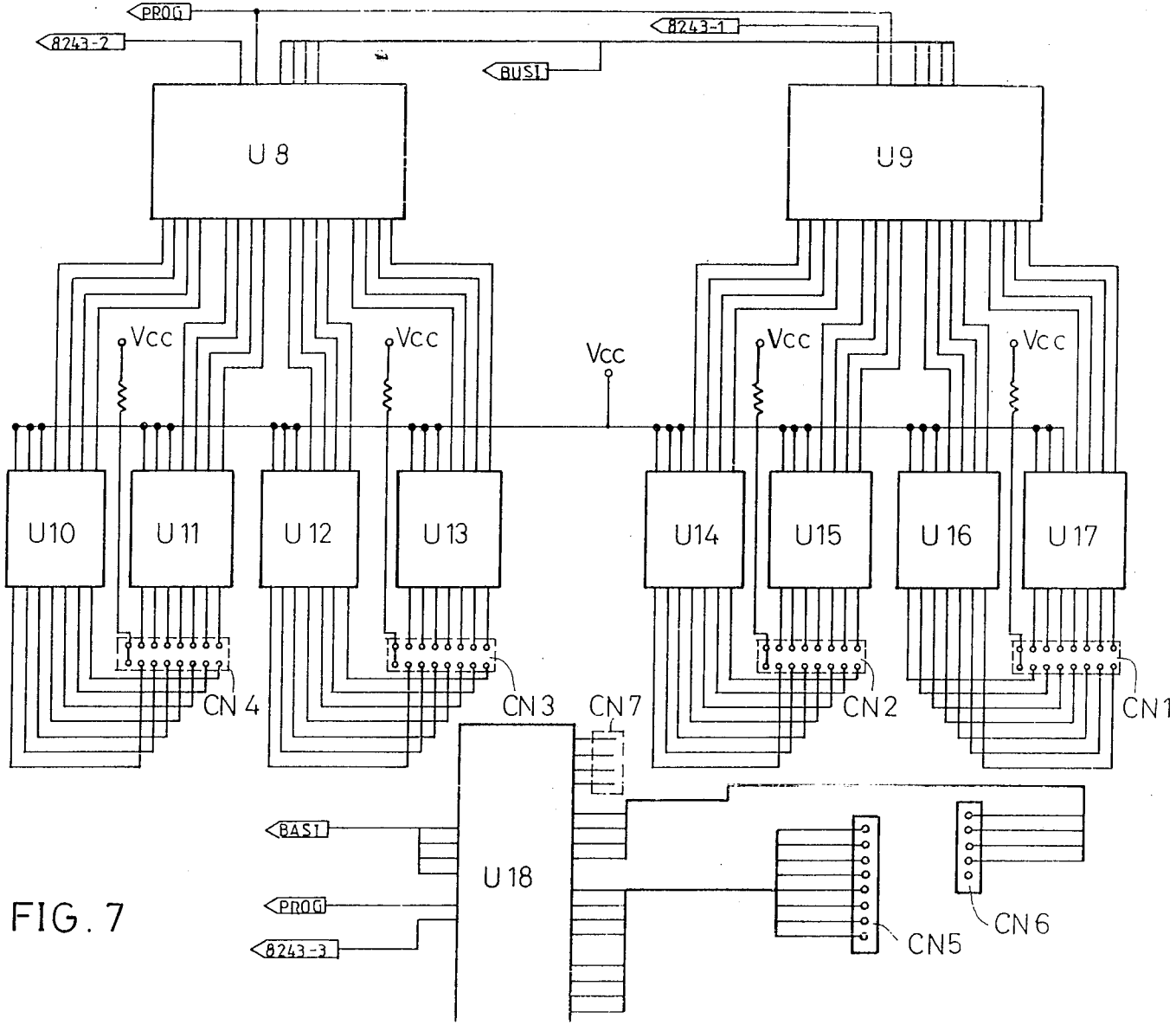
FIG. 7 is another control circuit diagram of the present invention.

Referring to the flow chart and the control circuit diagrams of the present invention as illustrated in FIGS. 5, 6 and 7 respectively, therein RELY1 to RELY4 are respectively connected to terminal CN7 for auxilliary input; RELY5 for burglar alarm start control; RELY6 for forwarding control of the handcuff mechanism; RELY7 controls the releasing of the handcuff from locked position; RELY8 for locking control of the handcuff; RELY9 controls pull back of the handcuff; CN10 provides an emergency triggering control; CN12 provides a rest control; central processor U1 executes the operational procedure; U2 is a 2 K ROM; U3 is an octal latch to lock up address and data; U4 and U5 are decoders; and U6 and U7 are driver circuits to drive relays RELY1 through RELY9. In the circuit diagram of FIG. 7, connecting terminals CN1 to CN4 are for connection thereto of display; connecting terminals CN5 and CN6 are for keyboard input; connecting terminal CN7 is an auxiliary input end; U8 and U9 form an I/O port for output control; U10 to U17 form a driver circuit to control display; and U18 is an I/O port for input control.

The control circuits of the present invention, as illustrated in FIGS. 6 and 7, are operated as hereunder:

When the central processor (U1) accepts a 6-digit numerical code setting, it immediately drives the octal latch (U3) to lock up address and data to further store in the read only memory (ROM) to complete the code setting process. In order to unlock the safe deposit box after setting of numerical code, the pre-set 6-digit numerical code must be input through the central processor (U1) and the octal latch (U3) for checking by the read only memory (ROM) U2. As soon as input code is confirmed by the read only memory (ROM), the lock of the safe deposit box is immediately and automatically opened. When three continuous wrong inputs are given, the central processor (U1) will immediately provide an output signal to the decoder (U5) to cause the decoder (U5) to send a control signal through the driver circuit (U7) to trigger the RELY6 to drive the handcuff to move forward. Immediately after the handcuff is pushed out, the RELY8 is consequentially triggered to drive the handcuff to snap down. The RELY7 is arranged to release the handcuff from locked position, and the RELY9 controls pull back of the handcuff.

Referring to FIG. 7 again, keyboard signal is sent from the terminals CN5 and CN6 through the I/O port (U18) to the central processor (U1) for processing, and to the I/O port (U8, U9) for input control. The keyboard signal to the I/O port (U8, U9) is further sent through the driver circuit (U10 to U16) to pass through terminals (CN1 to CN4) to drive the connected display to show the keyed-in numerical code.

According to the present invention, the intellectronic safe deposit box is also equipped with a battery power supply to keep operating during AC power failure. In case the intellectronic safe deposit box is hit by outer force or removed away from its position, the connected alarm system will be immediately triggered to alarm.

What is claimed is:

1. An intellectronic safe deposit box, including a housing unitarily made of special alloy and an electronic security control portion, wherein said electronic security control portion comprises a control circuit to control a handcuff mechanism and a display control panel, comprising, a handcuff mechanism, a display control panel, a slot and a bullet-proof window glass, said control circuit being comprised of a central processor to execute the working procedure of the circuit, an octal latch, a read only memory, a decoder, several relays to control the operation of an alarm and said handcuff mechanism, a first driver circuit to drive said relays to operate, a second driver circuit to drive the display of said display control panel and keyboard input terminals, said display control panel being comprised of a 7-segment 6-digit display and a keyboard, said handcuff mechanism being comprised of a first motor to control transverse movement of a handcuff, a gear wheel, a movable rack, a second motor to control the locking and unlocking of said handcuff, a pivoted arm, a check means and a handcuff, said check means being comprised of a ratchet and a transverse check pin.

2. The intellectronic safe deposit box as set forth in claim 1, wherein the slot of the electronic security control portion is properly made in size suitable for insertion therethrough of an ordinary person's hand.

3. The intellectronic safe deposit box as set forth in claim 1, wherein the handcuff mechanism is set inside the electronic security control portion by one side of the slot.

4. The intellectronic safe deposit box as set forth in claim 1, wherein the display control panel is obliquely set inside the slot beneath the bullet-proof window glass.

5. An intellectronic safe deposit box comprising a housing structure (1,2) having an upper surface and a horizontal slot (11) extending therein below said upper surface to accommodate a person's hand; a transparent panel (12) in the housing structure upper surface in contiguous relation to said horizontal slot; a control panel (110) arranged in said slot for viewing through the transparent panel; said control panel comprising a keyboard containing a multiple number of manually-operable keys (11*b*) reachable only through said slot, and a multiple digit display (11*a*) viewable through said transparent panel; a motor-operated handcuff mechanism movably mounted within said housing structure for movement between a retracted position offset from said slot and an operating position extending within said slot; said handcuff mechanism comprising a slide structure (122) movable in a direction transverse to said slot, a first motor (12*a*) for operating said slide structure, a handcuff arm (123) pivotably connected to said slide structure, and a second motor (12*b*) carried on said slide structure for moving said handcuff arm between a raised position and a lowered position adapted to partially encircle the arm of a person in the act of operating the keyboard; a first circuit means for operating said multiple digit display (11*a*) in response to manual operation of said keyboard; and second circuit means for controlling the operation of said first and second motors as a response to manual operation of the keyboard; said second circuit means including means establishing an electronic code and means for comparing an electronic output from the keyboard to said electronic code.

* * * * *